US007520505B2

(12) United States Patent
Thomas et al.

(10) Patent No.: US 7,520,505 B2
(45) Date of Patent: Apr. 21, 2009

(54) HIGH SPEED VERTICAL RECIPROCATING SHEET TRAIL EDGE STACKING ASSISTANCE SYSTEM

(75) Inventors: David Thomas, High Wycombe (GB); Kenneth C. Smith, Stevenage (GB); Jeffrey W. Ryan, Knebworth (GB); Christopher Pearce, Stevenage (GB)

(73) Assignee: Xerox Corporation, Norwalk, CT (US)

( * ) Notice: Subject to any disclaimer, the term of this patent is extended or adjusted under 35 U.S.C. 154(b) by 501 days.

(21) Appl. No.: 11/238,722

(22) Filed: Sep. 29, 2005

(65) Prior Publication Data

US 2007/0069453 A1 Mar. 29, 2007

(51) Int. Cl.
*B65H 31/26* (2006.01)

(52) U.S. Cl. ..... 271/220; 270/58.17

(58) Field of Classification Search ..... 271/220, 271/221; 270/58.12, 58.16, 58.17
See application file for complete search history.

(56) References Cited

U.S. PATENT DOCUMENTS

| | | | | | |
|---|---|---|---|---|---|
| 3,406,966 | A | * | 10/1968 | Walton | 271/176 |
| 4,068,839 | A | * | 1/1978 | Bullock et al. | 271/180 |
| 4,436,301 | A | | 3/1984 | Doery et al. | |
| 4,611,800 | A | | 9/1986 | Parsons et al. | |
| 5,026,034 | A | | 6/1991 | Russel et al. | |
| 5,120,047 | A | | 6/1992 | Mandel et al. | |
| 5,289,251 | A | | 2/1994 | Mandel et al. | |
| 5,342,034 | A | | 8/1994 | Mandel et al. | |
| 5,473,420 | A | * | 12/1995 | Rizzolo et al. | 399/107 |
| 5,503,017 | A | | 4/1996 | Mizukoshi | |
| 5,649,695 | A | * | 7/1997 | Lawrence | 270/58.12 |
| 5,662,322 | A | * | 9/1997 | Kawaguti | 271/84 |
| H1781 | H | | 2/1999 | Mandel et al. | |
| 6,095,518 | A | * | 8/2000 | Allmendinger et al. | 271/215 |
| 6,145,825 | A | * | 11/2000 | Kunihiro et al. | 270/58.09 |
| 6,394,448 | B2 | * | 5/2002 | Suzuki et al. | 271/189 |
| 7,207,556 | B2 | * | 4/2007 | Saitoh et al. | 270/58.08 |
| 2002/0063380 | A1 | * | 5/2002 | Tamura et al. | 271/220 |
| 2002/0113362 | A1 | * | 8/2002 | Saito et al. | 271/207 |
| 2003/0062670 | A1 | * | 4/2003 | Silverbrook | 271/207 |
| 2004/0251608 | A1 | * | 12/2004 | Saito et al. | 271/220 |
| 2007/0057441 | A1 | * | 3/2007 | Tsutsui et al. | 271/207 |
| 2007/0257421 | A1 | * | 11/2007 | Sanmiya | 271/221 |
| 2008/0315494 | A1 | * | 12/2008 | Terao et al. | 270/58.12 |

FOREIGN PATENT DOCUMENTS

WO WO 2006/039734 A1 4/2006

* cited by examiner

*Primary Examiner*—Patrick H Mackey
*Assistant Examiner*—Gerald W McClain
(74) *Attorney, Agent, or Firm*—Fay Sharpe LLP

(57) ABSTRACT

A print media sheets trailing edge knockdown stacking assistance system, in a compiler or other stacking system with a substantial sheet gravity drop, activated for each ejected sheet to move substantially linearly and perpendicularly downwardly from above, but adjacent to, the sheet ejection position to engage a sheet end area and rapidly push it down towards the underlying stack of sheets and into engagement with any sheet compiling device, then automatically rapidly reciprocally lifting up out of the way above the sheet ejection position before another sheet is ejected, without any significant pause between its up and down movements.

8 Claims, 3 Drawing Sheets

HIGH SPEED VERTICAL RECIPROCATING SHEET TRAIL EDGE STACKING ASSISTANCE SYSTEM

Disclosed in the embodiments herein is an improved active print media sheets stacking assistance system for decreasing the normal settling time required for an incoming sheet to settle down on top of a stack of previously ejected sheets, especially in a compiler with a substantial sheet drop and/or an active compiling registration system, and/or to improve the stacking and stack registration of sheets with curled trail edge areas, with a quick acting, quick sheet releasing, reciprocating active sheet knock-down system.

By way of background there is noted Xerox Corp. U.S. Pat. No. 4,436,301 issued Mar. 13, 1984, on an active sheet stacking assistance system (n a recirculating document handler). Also noted as to sheet stacking assistance systems are Eastman Kodak U.S. Pat. No. 5,026,034 issued Jun. 25, 1991 and U.S. Pat. No. 4,611,800 issued Sep. 16, 1986.

A specific feature of the specific embodiment disclosed herein is to provide a sheet stacking system in which flimsy print media sheets are sequentially ejected from a sheet ejection position to drop by gravity onto an underlying stack of other such flimsy print media sheets to be superposed thereon, there is provided a sheet stacking assistance system comprising a system for providing a signal that the trailing edge of a print media sheet is being ejected from said sheet ejection position, a print media sheet trailing edge knockdown system activated in response to said signal that the trailing edge of a print media sheet is being ejected from said sheet ejection position, said print media sheet trail edge knockdown system moving substantially linearly downwardly from above said sheet ejection position and past said sheet ejection position to engage a trailing edge area of said ejected print media sheet to rapidly push said print media sheet rapidly downwardly towards said underlying stack of other such flimsy print media sheets, said print media sheet trail edge knockdown system then automatically rapidly reciprocally lifting up away from said print media sheet to above said sheet ejection position before a subsequent said sequential ejection of a print media sheet from said sheet ejection position.

Further specific features disclosed in the embodiment herein, individually or in combination, include those wherein said sheet stacking system comprises a compiler stacking tray with an active print media sheets compiling system for engaging and pulling said print media sheet towards a print media sheets registration position when said print media sheet trail edge knockdown system automatically rapidly reciprocally lifts up away from said print media sheet and before a subsequent said sequential ejection of a print media sheet from said sheet ejection position; and/or wherein said print media sheet trailing edge knockdown system is reciprocally rack and gear driven for a substantially defined stroke length substantially perpendicularly to said underlying stack of other such flimsy print media sheets; and/or wherein said print media sheet trailing edge knockdown system has a sheet knockdown member that is substantially vertically reciprocally driven adjacent to said sheet ejection position in sequential up and down movements without any substantial pause between said up and down movements; and/or a method of sheet stacking in which flimsy print media sheets are sequentially ejected from a sheet ejection position to drop by gravity onto an underlying stack of other such flimsy print media sheets to be superposed thereon, there is provided sheet stacking assistance method comprising providing a signal that the trailing edge of a print media sheet is being ejected from said sheet ejection position, activating an automatic print media sheet trailing edge area knockdown system in response to said signal that the trailing edge of a print media sheet is being ejected from said sheet ejection position, moving said print media sheet trail edge knockdown system substantially linearly downwardly from above said sheet ejection position past said sheet ejection position to engage a trailing edge area of said ejected print media sheet to rapidly push said ejected print media sheet downwardly towards said underlying stack of other such flimsy print media sheets, said print media sheet trail edge knockdown system then automatically rapidly reciprocally lifting up away from said print media sheet to above said sheet ejection position before a subsequent said sequential ejection of a print media sheet from said sheet ejection position; and/or comprising a compiler stacking tray with an active print media sheets compiling system engaging and pulling said print media sheet towards a print media sheets registration position when said print media sheet trail edge knockdown system automatically rapidly reciprocally lifts up away from said print media sheet and before a subsequent said sequential ejection of a print media sheet from said sheet ejection position; and/or wherein said print media sheet trailing edge knockdown system is reciprocally rack and gear driven in a substantially defined stroke length substantially perpendicularly to said underlying stack of other such flimsy print media sheets; and/or wherein said print media sheet trailing edge knockdown system has a sheet knockdown member that is substantially vertically reciprocally driven adjacent to said sheet ejection position in sequential up and down movements without any substantial pause between said up and down movements.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical substrate for images, whether precut or web fed.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the examples below, and the claims. Thus, they will be better understood from this description of specific embodiments, including the drawing figures (which are approximately to scale) wherein:

Figure 1:
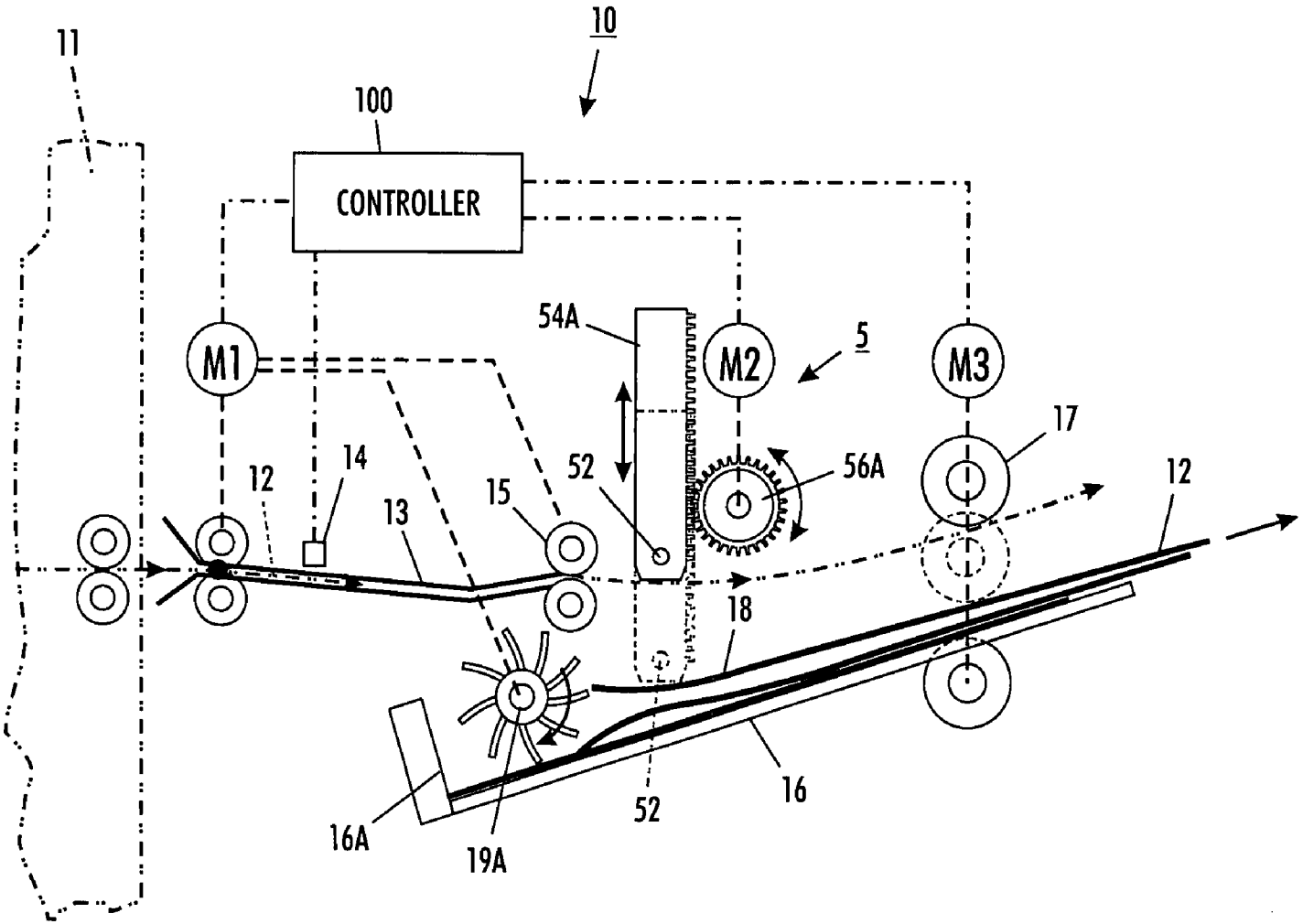
FIG. 1 is a frontal schematic view of one example of a sheet compiler for the output of a printer containing one example of a subject improved sheet trail edge knockdown system.

Describing now in further detail the exemplary embodiments with reference to the Figures, there is shown a sheet knockdown tamping mechanism 5 assisting in a printer 11 output sheets 12 compiling operation. An uphill stacking finisher module compiler is shown in both FIGS. 1 and 2, although the potential applications of this tamping system 5 are not limited to the compiler 10 of FIG. 1 or the compiler 20 of FIG. 2. Such compiling systems per se are well known, such those described in more detail in Xerox Corp. U.S. Pat. Nos. 5,120,047; 5,289,251; 5,503,017; 5,342,034; and U.S. SIR H1781, incorporated by reference, and hence need not be described in detail herein. Here, similarly, both compilers 10 and 20 have a conventional input path 13, sheet trail edge position optical sensor 14, eject rolls 15, inclined compiler tray 16, rear wall sheet registration surface 16A, and a closable set ejector nip 17 to eject a compiled and registered sheet set stack 18 on to any desired set finishing station. The rotating flexible blades sheet compiling assistance system 19A of FIG. 1 and the alternative rotating floppy belt compiling assistance system 19B of FIG. 2 are also well known and taught in the above-cited and other references. Conventional software programming in the printer 11 controller and/or a separate controller 100 for the compiler may be provided, controlling respective drive motors M1, M3, and the additional motor M2 for the sheet knockdown tamping mechanism 5 here.

The tamping system 5 illustrated here pushes down a tamping member 52 against the trailing edge area of each sheet shortly after each sheet leaves the compiler sheet eject rolls 15. This reduces the sheet settling (dropping) time and ensures that the sheet trail edge can be properly acquired by the process direction registration assistance system 19A or 19B to be fed back to the rear registration wall 16A of the compiler tray 16.

The tamping movement of the system 5 is a rapid long stroke downward tamping movement toward the top of the stack, adjacent to the rear of the stack, rapidly followed by a rapid upward movement to get up out of the way of the next incoming sheet, and to allow the tamped down sheet to register. The rapid subsequent upward movement releases the tamped sheet 12 so as to not interfere with subsequent transverse movement of that tamped down sheet 12 parallel to the stack 18 surface. That lateral sheet 12 movement allows for the capture of the sheet trail edge area under and by the registration assistance system 19A or 19B, for registration of the sheet trailing edge against the rear edge registration surface 16A and thus superposition stacking alignment with the previously ejected and now underlying sheets in the stack 18. That is, each incoming sheet 12 is rapidly released from contact with the tamper 52 as soon as that sheet's trail edge area been knocked down at least a substantial portion of the way down towards the stack 18. This illustrated tamping member movement here is substantially vertical, axial and reciprocal and perpendicular to the stack surface. If desired, a soft surface can be provided on the contacting end of the tamping member for noise reduction.

Figure 2:
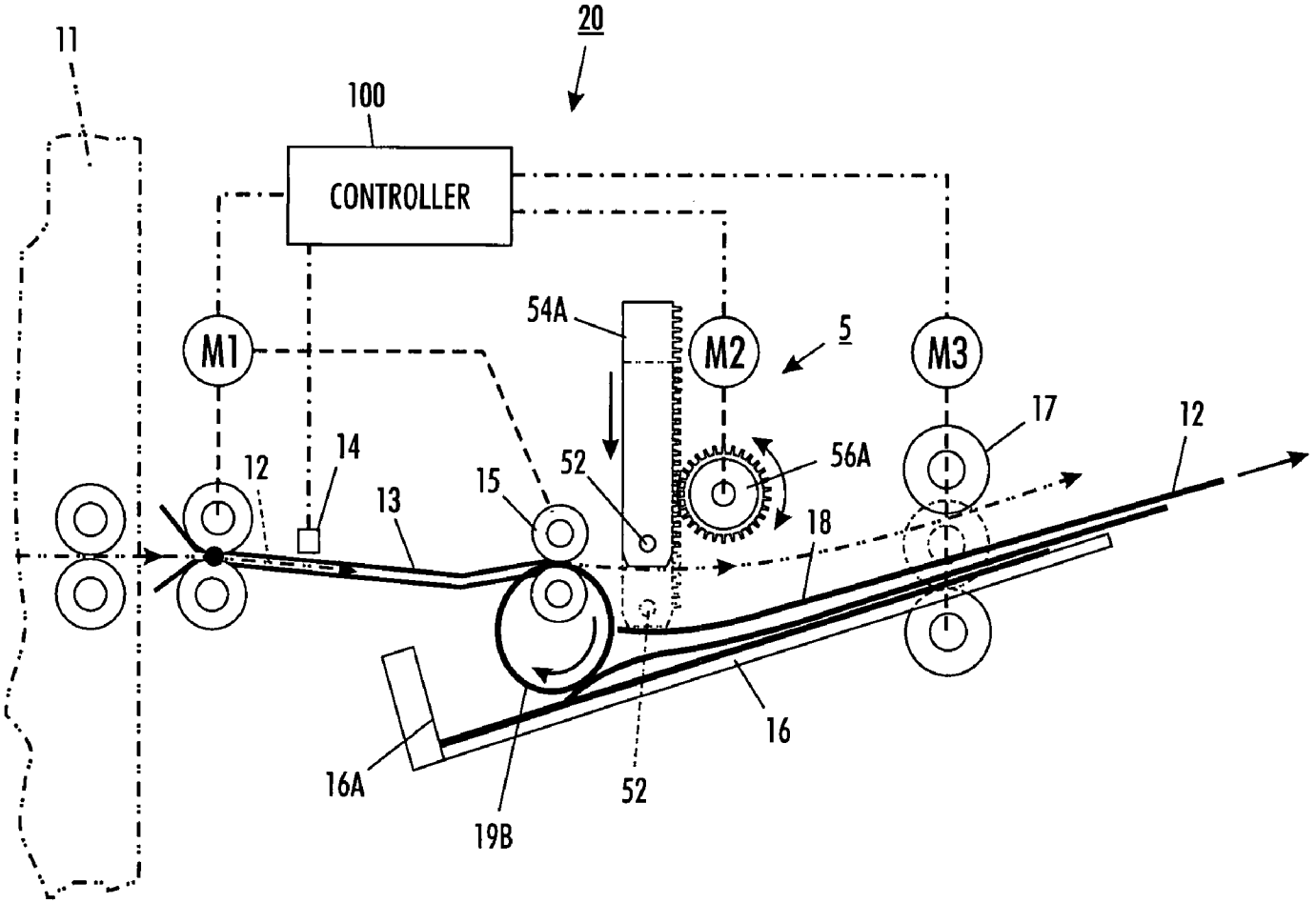
FIG. 2 is the same as FIG. 1 except that the exemplary schematically illustrated compiler is of a known floppy belt type instead of a plural paddle blades type.
Figure 3:
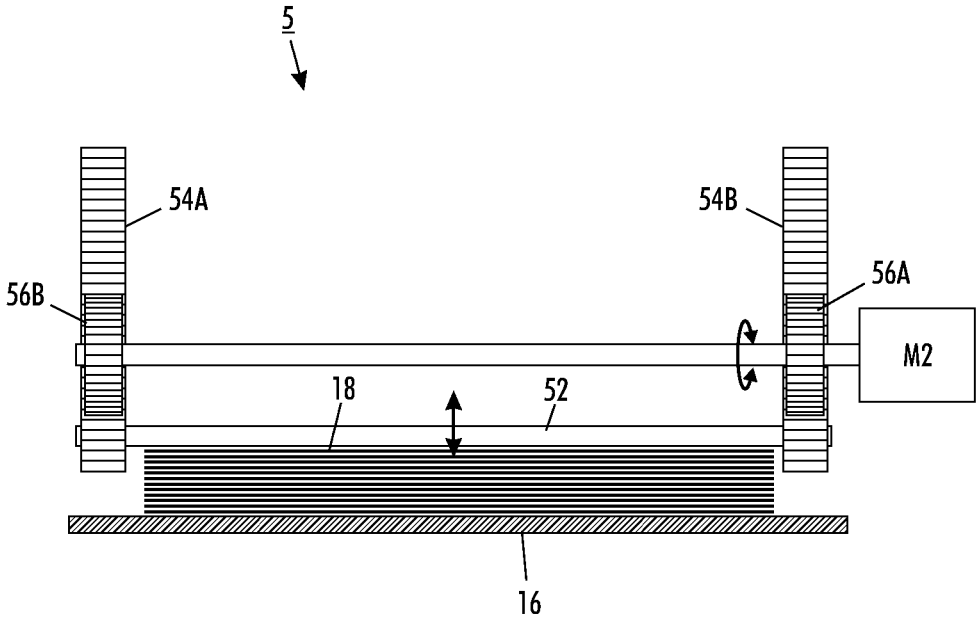
FIG. 3 is a partial schematic end view of the improved sheet trail edge knockdown system example of FIGS. 1 and 2.

FIGS. 1-3 show in a solid line position the vertically moveable tamping system 5 in a normal upper position out of the way of the incoming sheets, and in the phantom line position its lowered sheet tamping position. Two linear racks 54A and 54B on each side of the paper path may driven via motor/gear combination M2 and 56A, 56B on a common interconnecting shaft reciprocally moving these two racks 54A and 54B (one on each side of compiler tray 16) up and down within respective conventional slide mountings. The stroke length of these two racks 54A and 54B, and thus of this vertical tamping system 5, may be defined by gear ratios and/or conventional end of movement flag sensors, stepper motor pulses, or otherwise. The rack and pinion drive example illustrated here may be conventional per se, of course.

This system provides a rapid movement for a very temporary (fast dropping and fast lifting) incoming sheet trail edge impact with a reciprocal axial downward movement substantially perpendicular to the stack surface. As noted above, by rapidly lifting away from the sheet after tamping it down towards or onto the previously stacked sheet in the compiler tray the disclosed system does not significantly interfere with the movement of that latest stacked sheet substantially parallel to or along the stack surface, such as by sliding and/or being actively fed back downhill in the compile tray for compiling registration. That is unlike cited prior art on holding down on the top sheet with an arm that comes out from behind the rear stacking guide to rest on and stay on the top of the stack. The latter could also undesirably interfere with other mechanisms in that area.

The particular driving system here, in which the vertical tamping mechanism may be fixed to two racks which move up and down in a slide mounting, and a motor drives the rack via two gears (one gear driving each rack) enables a much longer vertical stroke of a tamping arm. This accommodates the height of the paddle or floppy belt or other set compiling technology 19A or 19B, which can, as shown, require a higher sheet drop height between the compiler entrance (sheet ejector) rolls (above that system 19A or 19B) and the compiler tray.

The compiling systems here show the sheets being typically ejected from compiler entrance rolls. The vertical tamping arm desirably contacts the trail edge area of sheets adjacent the sheet ejection area and at substantially the same position on the sheet each time, irrespective of sheet size, not at the position of the compiler rear edge guide as in some of the cited art. For the FIG. 1 illustrated rotating paddles compiling registration system the sheet trail edge is positively tamped low enough for the paddles to acquire the incoming dropping sheet and to then retract that sheet by paddle engagement back to the compiler tray back-stop to providing the process direction registration for the sheet set being compiled.

The tamping system may be triggered from a sheet edge detection sensor within the paper path, such as near the sheet ejection position to the compiler, such as the sheet trail edge sensor 14 illustrated here. A delay time period from this sensor actuation to the tamper drive actuation may be provided so as to contact the trail edge area of a sheet in the desired location, which will not of course be at the actual end of the sheet.

The motion of the system 5 may be considered into three stages: downward movement time, delay time whilst in the most downward position, and upward movement time. Or, considered in terms of a tamping time, tamper retraction time, and tamper sheet engagement time:

Below are some examples of a suitable tamping time, retraction time, and sheet engagement time:

| | |
|---|---|
| Tamping time (downward motion) | 75 to 85 milliseconds |
| Retraction time (upward motion) | 115 to 125 milliseconds |
| Sheet engagement time | approximately 200 milliseconds |

These timings are based upon a tamper drive stroke distance of 40 mm. However, please note all these timings are for a particular hardware example. The basic concept can be applied to any hardware as long as these values are adjusted accordingly to achieve the desired objectives for the particular compiler or other pint media sheets stacking system. That is, a tamping mechanism which acts on the trail edge area of the incoming sheet to help ensure that the sheet is presented in the correct position for effective set compiling.

Current compilers can have particular difficulty in accurately compiling a set of output print media sheets when faced with dealing with a wide range of different sizes and weights or thicknesses of sheets, which can have different settling and stacking characteristics. Also performance degradation can occur from the stress of up-curled or down-curled sheets being compiled. The disclosed system provides more reliable engagement and registration of the trail edge area of various such stacking sheets and thus provides more accurate compiling for a wide range paper sizes and stress conditions including up-curled or down-curled sheets.

Advantages can include, depending on the particular application, accommodating large sheet drop heights (such as due to paddle compiling registration assistance technology) with minimal changes in, or interference with, paper paths or other components, with a long and substantially vertical sheet knock-down stroke. Also, having a small profile tamping arm that extends transversely across the compiler tray, as shown, allows the system to can operate within a small working space. This is particularly desirable when there is a limited space available above the exit rolls shaft. Furthermore, as shown, the racks can be positioned outside the frame and outside of the compiler tray, again reducing the need for additional working space within the unit. The vertical tamping arm acts vertically downward on sheet, forcing to the sheet down towards the paddle assembly. The tamping arm can acts vertically down across substantially the same line or point on the sheets, just as the sheets leave the exit rolls, and by doing so also reduce the change of "trail edge hang-ups" of sheet trail edges at the exit roll area. These various advantages of this active system offer better latitude to cope with papers of different sizes and weights.

As noted, the disclosed embodiment desirably overcomes some of the problems caused large sheet drop heights of the ejected sheets onto the underlying stacking surface of the compiler. In particular, where the sheet may need to drop over or past a rotating paddles compiling registration system or a commonly used floppy belt compiling system, such in the above-cite Xerox Corp. U.S. Pat. Nos. 5,120,047; 5,289,251; 5,503,017; 5,342,034; and U.S. SIR H1781. Also, the disclosed embodiment can contact incoming sheet trail edge areas more consistently, in the same position, to providing increased latitude for compiling various different paper sizes and weights.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. In a sheet stacking system in which non-rigid print media sheets are: sequentially ejected from a sheet ejection position to drop onto an underlying stack of other such non-rigid print media sheets to be superposed thereon, there is provided a sheet stacking assistance system comprising:

a system for providing a signal that the trailing edge of a print media sheet is being ejected from said sheet ejection position, a rack and gear driven print media sheet trailing edge knockdown system activated in response to said signal that the trailing edge of a print media sheet is being ejected from said sheet ejection position, said print media sheet trail edge knockdown system moving substantially linearly downwardly from above said sheet ejection position and past said sheet ejection position to engage a trailing edge area of said ejected print media sheet to rapidly push said print media sheet rapidly downwardly towards said underlying stack of other such non-rigid print media sheets, said print media sheet trail edge knockdown system then automatically rapidly reciprocally lifting up away from said print media sheet to above said sheet ejection position before a subsequent said sequential ejection of a print media sheet from said sheet ejection position.

2. The sheet stacking system of claim 1 wherein said sheet stacking system comprises a compiler stacking tray with a rotating active print media sheets compiling system for engaging and pulling said print media sheet towards a print media sheets registration position when said print media sheet trail edge knockdown system automatically rapidly reciprocally lifts up away from said print media sheet and before a subsequent said sequential ejection of a print media sheet from said sheet ejection position.

3. The sheet stacking system of claim 1 wherein said rack and gear driven print media sheet trailing edge knockdown system reciprocates for a substantially defined stroke length substantially perpendicularly to said underlying stack of other such non-rigid print media sheets.

4. The sheet stacking system of claim 1 wherein said print media sheet trailing edge knockdown system has a sheet knockdown member that is substantially vertically reciprocally driven adjacent to said sheet ejection position in sequential up and down movements without any substantial pause between said up and down movements.

5. In a method of sheet stacking in which non-rigid print media sheets are sequentially ejected from a sheet ejection position to drop onto an underlying stack of other such non-rigid print media sheets to be superposed thereon, there is provided sheet stacking assistance method comprising:

providing a signal that the trailing edge of a print media sheet is being ejected from said sheet ejection position, activating an automatic rack and gear driven print media sheet trailing edge area knockdown system in response to said signal that the trailing edge of a print media sheet is being ejected from said sheet ejection position, moving said print media sheet trail edge knockdown system substantially linearly downwardly from above said sheet ejection position past said sheet ejection position to engage a trailing edge area of said ejected print media sheet to rapidly push said ejected print media sheet downwardly towards said underlying stack of other such non-rigid print media sheets, said print media sheet trail edge knockdown system then automatically rapidly reciprocally lifting up away from said print media sheet to above said sheet ejection position before a subsequent said sequential ejection of a print media sheet from said sheet ejection position.

6. The method of sheet stacking of claim 5 comprising a compiler stacking tray with a rotating active print media sheets compiling system engaging and pulling said print media sheet towards a print media sheets registration position when said print media sheet trail edge knockdown system automatically rapidly reciprocally lifts up away from said print media sheet and before a subsequent said sequential ejection of a print media sheet from said sheet ejection position.

7. The method of sheet stacking of claim 5 wherein said print media sheet trailing edge knockdown system is reciprocally rack and gear driven in a substantially defined stroke length substantially perpendicularly to said underlying stack of other such non-rigid print media sheets.

8. The method of sheet stacking of claim 5 wherein said print media sheet trailing edge knockdown system has a sheet knockdown member that is substantially vertically reciprocally driven adjacent to said sheet ejection position in sequential up and down movements without any substantial pause between said up and down movements.

* * * * *